US006019483A

United States Patent [19]

Lin

[11] Patent Number: 6,019,483

[45] Date of Patent: Feb. 1, 2000

[54] DECORATION LAMP DEVICE

[76] Inventor: Mei-Lu Lin, No.56, Min Sheng Street, Feng-Yuan City 420, Taiwan

[21] Appl. No.: 09/130,540

[22] Filed: Aug. 6, 1998

[51] Int. Cl.[7] ..... H01R 33/06

[52] U.S. Cl. ..... 362/226; 439/375; 439/619

[58] Field of Search ..... 362/226, 227, 362/249, 252; 439/375, 619, 699.2, 611; 313/318.01, 318.12

[56] References Cited

U.S. PATENT DOCUMENTS 5,443,399 8/1995 Jing et al. ..... 439/619
5,647,771 7/1997 Shu ..... 439/699.2
5,697,698 12/1997 Huang ..... 362/226
5,722,766 3/1998 Shu ..... 362/226
5,722,771 3/1998 Wang ..... 362/249
5,791,940 8/1998 Chen et al. ..... 439/619
5,829,865 11/1998 Ahroni ..... 362/229

*Primary Examiner*—Alan Cariaso

[57] ABSTRACT

A decoration lamp device has a lamp holder, a bulb disposed on the lamp holder, and a socket receiving the lamp holder. The lamp holder has a base portion having two through apertures and two lateral grooves, and a cylinder portion having two bottom grooves. The socket has an upper cylinder interior, a slot, and two protruded bars in the slot matching the lateral grooves. The base portion is inserted in the slot. The cylinder portion is inserted in the upper cylinder interior.

3 Claims, 8 Drawing Sheets

DECORATION LAMP DEVICE

BACKGROUND OF THE INVENTION

This invention relates to a decoration lamp device, and more particularly, this invention relates to a decoration lamp device which has a special lamp holder engaging with a socket stably.

Referring to FIG. 1, a conventional decoration lamp device comprises a bulb 3 disposed on a lamp holder 2, and a socket 1 receiving the lamp holder 2. The socket 1 has a cylinder interior 9 and a narrow interior 8 communicating with the cylinder interior 9. The lamp holder 2 has a cylinder portion 6 and a base portion 7. The base portion 7 has two bottom holes 5 receiving two lead-in wires 4 extending from the bulb 3. The base portion 7 is inserted in the narrow interior 8. The cylinder portion 6 is inserted in the cylinder interior 9. The cylinder interior 9 is larger than the cylinder portion 6. Therefore, the contact between the lead-in wire 4 and a conductive plate (not shown in the figure) may be loose.

SUMMARY OF THE INVENTION

An object of this invention is to provide a decoration lamp device which has a special lamp holder engaging with a socket stably.

Accordingly, a decoration lamp device comprises a lamp holder, a bulb disposed on the lamp holder, and a socket receiving the lamp holder. The lamp holder has a cylinder portion and a base portion. The base portion has two through apertures receiving two lead-in wires extending from the bulb, and two lateral grooves. The cylinder portion has two bottom grooves communicating with the lateral grooves. The socket has an upper cylinder interior, a slot communicating with the upper cylinder interior, and two protruded bars in the slot matching the lateral grooves. Each protruded bar has an upper end protruded into the upper cylinder interior. The base portion is inserted in the slot. The cylinder portion is inserted in the upper cylinder interior.

DETAILED DESCRIPTION OF THE INVENTION

Figure 1:
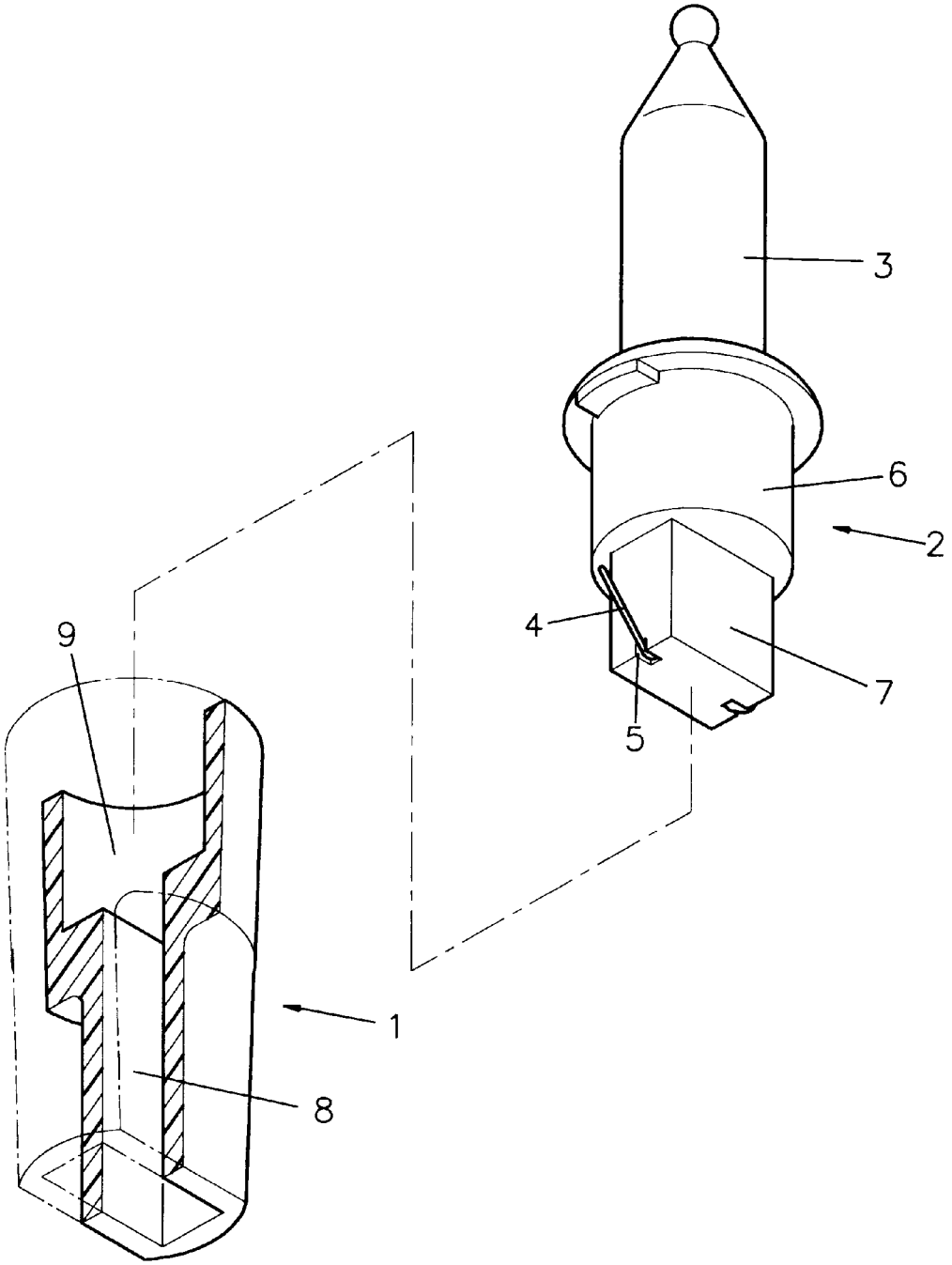
FIG. 1 Prior Art
FIG. 1 is a perspective exploded view of a decoration lamp device of the prior art.
Figure 2:
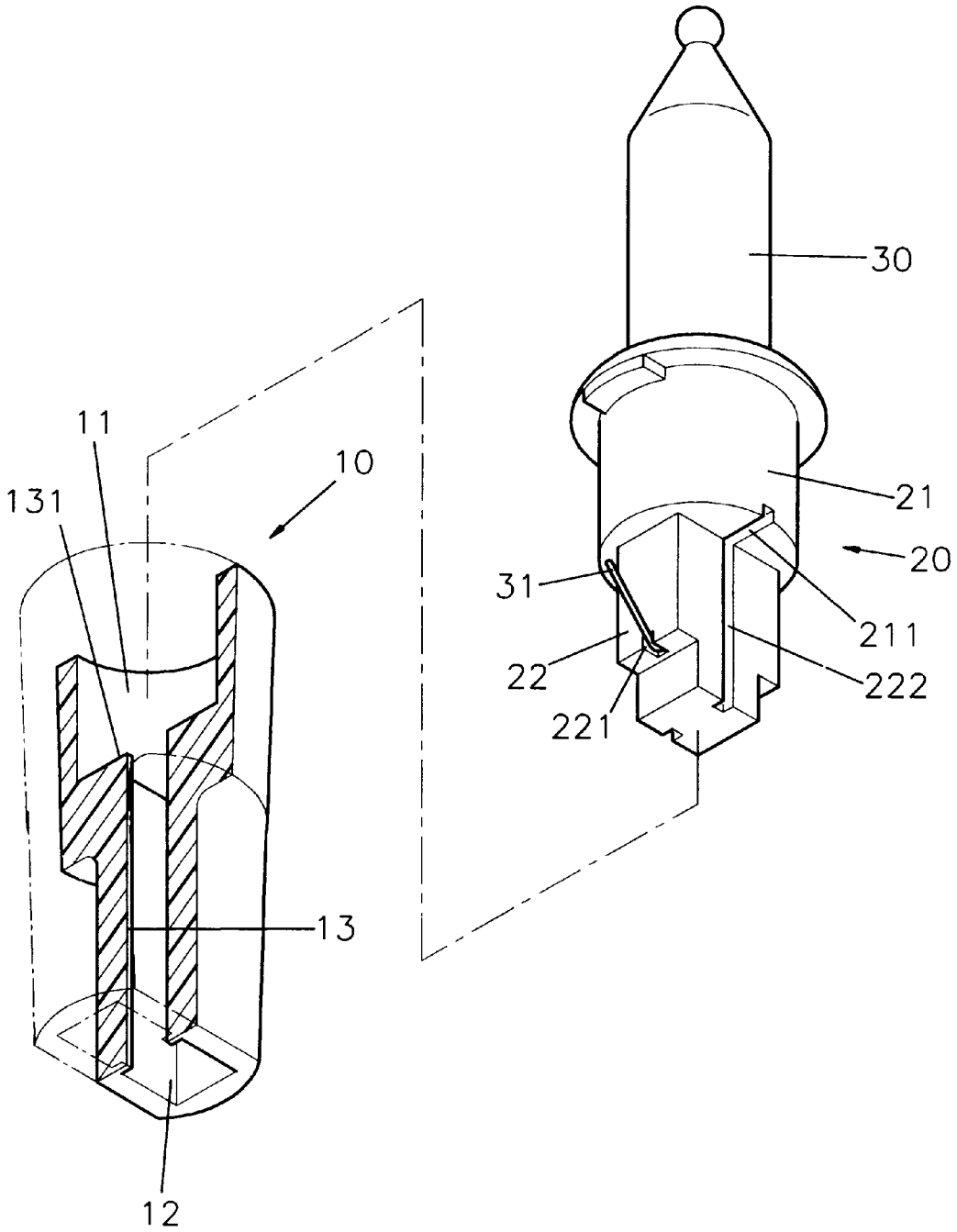
FIG. 2 is a perspective exploded view of a decoration lamp device of a first preferred embodiment.
Figure 4:
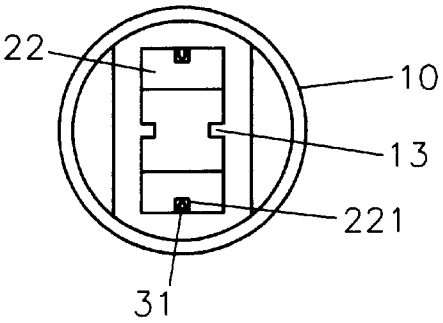
FIG. 4 is another sectional assembly view of a decoration lamp device of a first preferred embodiment.
Figure 3:
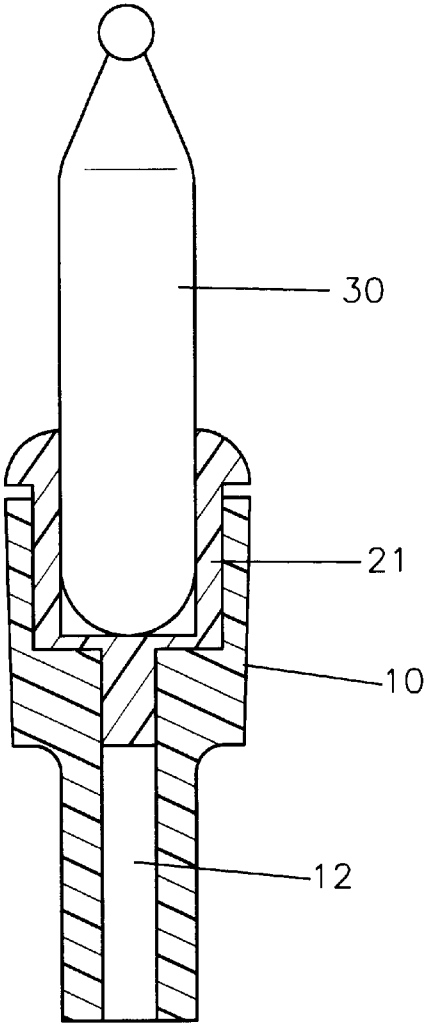
FIG. 3 is a sectional assembly view of a decoration lamp device of a first preferred embodiment.
Figure 5:
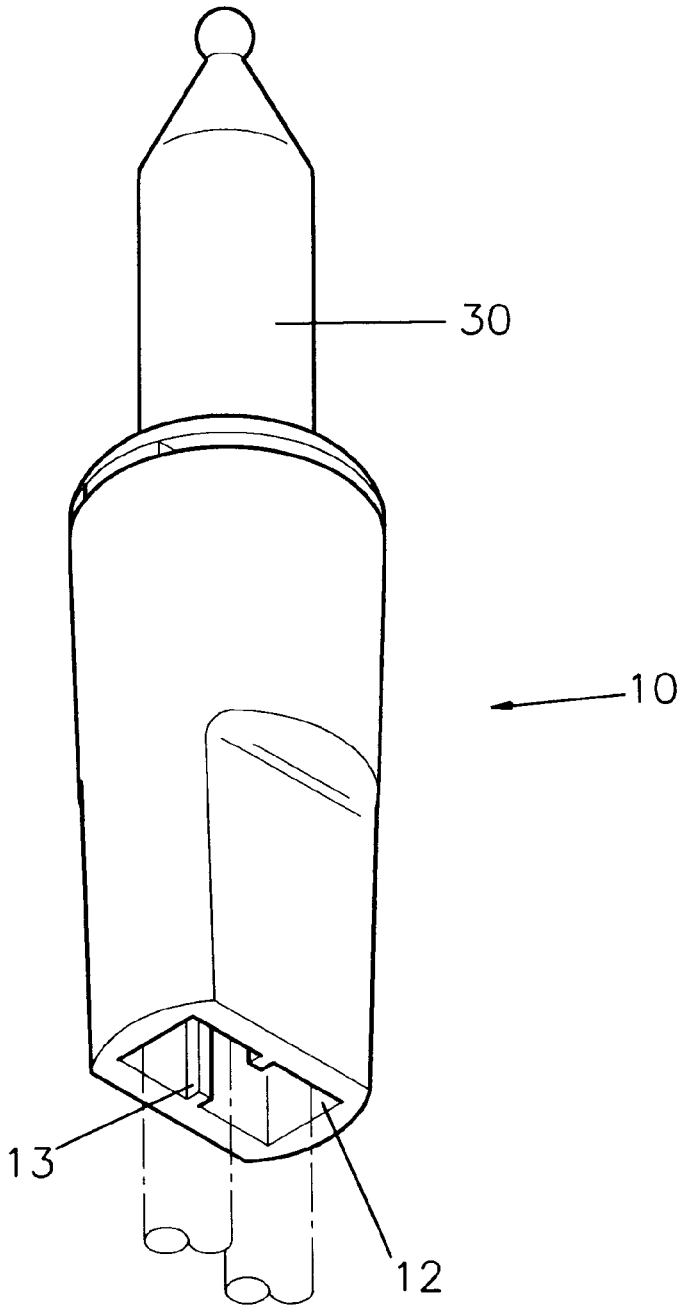
FIG. 5 is a perspective assembly view of a decoration lamp device of a first preferred embodiment.

Referring to FIGS. 2 to 5, a first decoration lamp device comprises a lamp holder 20, a bulb 30 disposed on the lamp holder 20, and a socket 10 receiving the lamp holder 20.

The lamp holder 20 has a cylinder portion 21 and a base portion 22. The base portion 22 has two through apertures 221 receiving two lead-in wires 31 extending from the bulb 30, and two lateral grooves 222. The cylinder portion 21 has two bottom grooves 211 communicating with the lateral grooves 222.

The socket 10 has an upper cylinder interior 11, a slot 12 communicating with the upper cylinder interior 11, and two protruded bars 13 in the slot 12 matching the lateral grooves 222. Each protruded bar 13 has an upper end 131 protruded into the upper cylinder interior 11.

The base portion 22 is inserted in the slot 12. The cylinder portion 21 is inserted in the upper cylinder interior 11. Each protruded bar 13 is inserted in the respective lateral groove 222. Therefore, the lamp holder 20 engages with the socket 10 stably.

Figure 6:
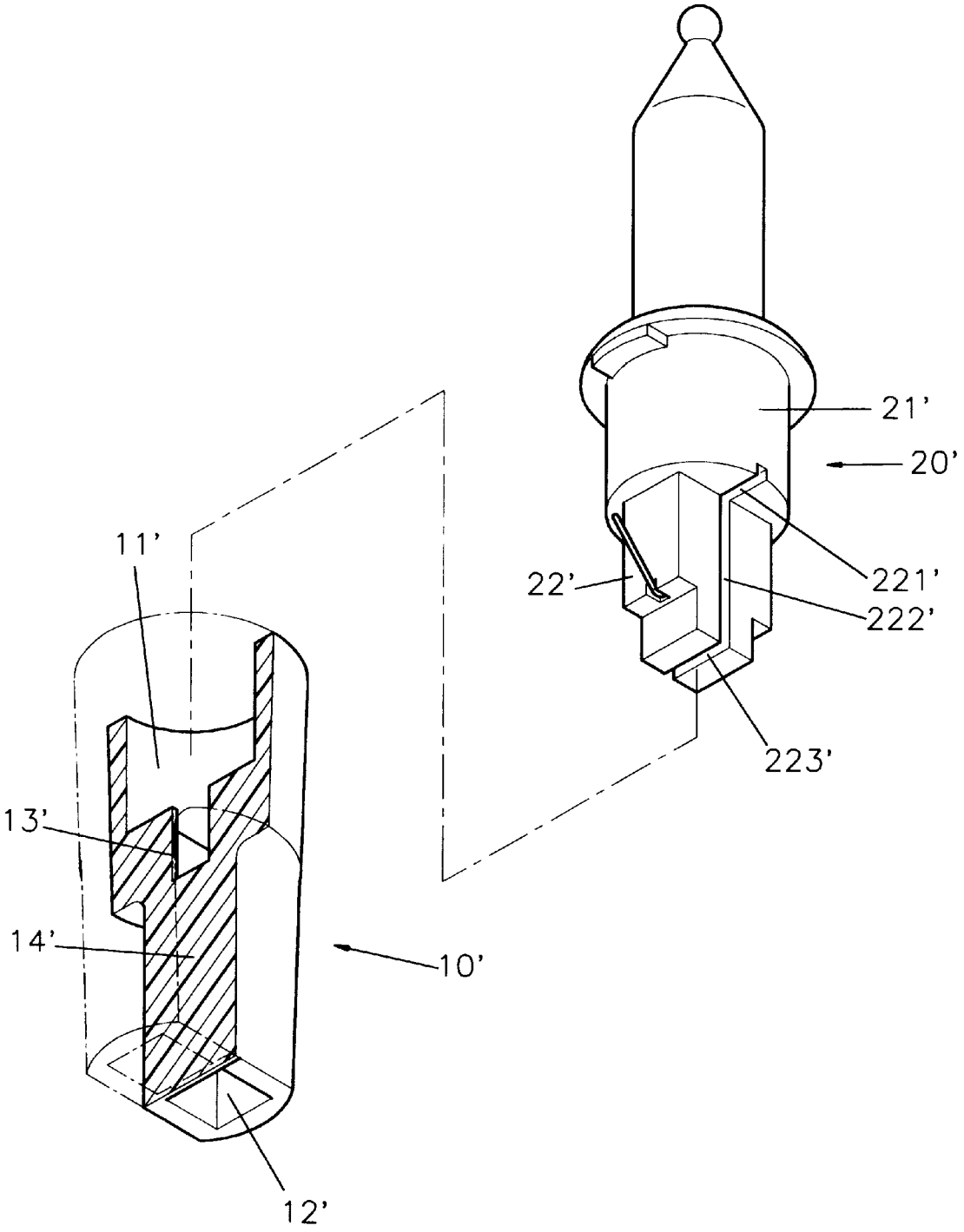
FIG. 6 is a perspective exploded view of a decoration lamp device of a second preferred embodiment.

Referring to FIG. 6, a second decoration lamp device comprises a lamp holder 20', and a socket 10' receiving the lamp holder 20'.

The lamp holder 20' has a cylinder portion 21' and a base portion 22'. The base portion 22' comprises a bottom recess 223' and two lateral grooves 222' communicating with the bottom recess 223'. The cylinder portion 21' has two bottom grooves 221' communicating with the lateral grooves 222'.

The socket 10' has an upper cylinder interior 11', a slot 12' communicating with the upper cylinder interior 11', and a separation plate 14' in the slot 12'. Two protruded bars 13' are protruded upward from the separation plate 14'.

The base portion 22' is inserted in the slot 12'. The cylinder portion 21' is inserted in the upper cylinder interior 11'. Each protruded bar 13' is inserted in the respective lateral groove 222'.

Figure 7:
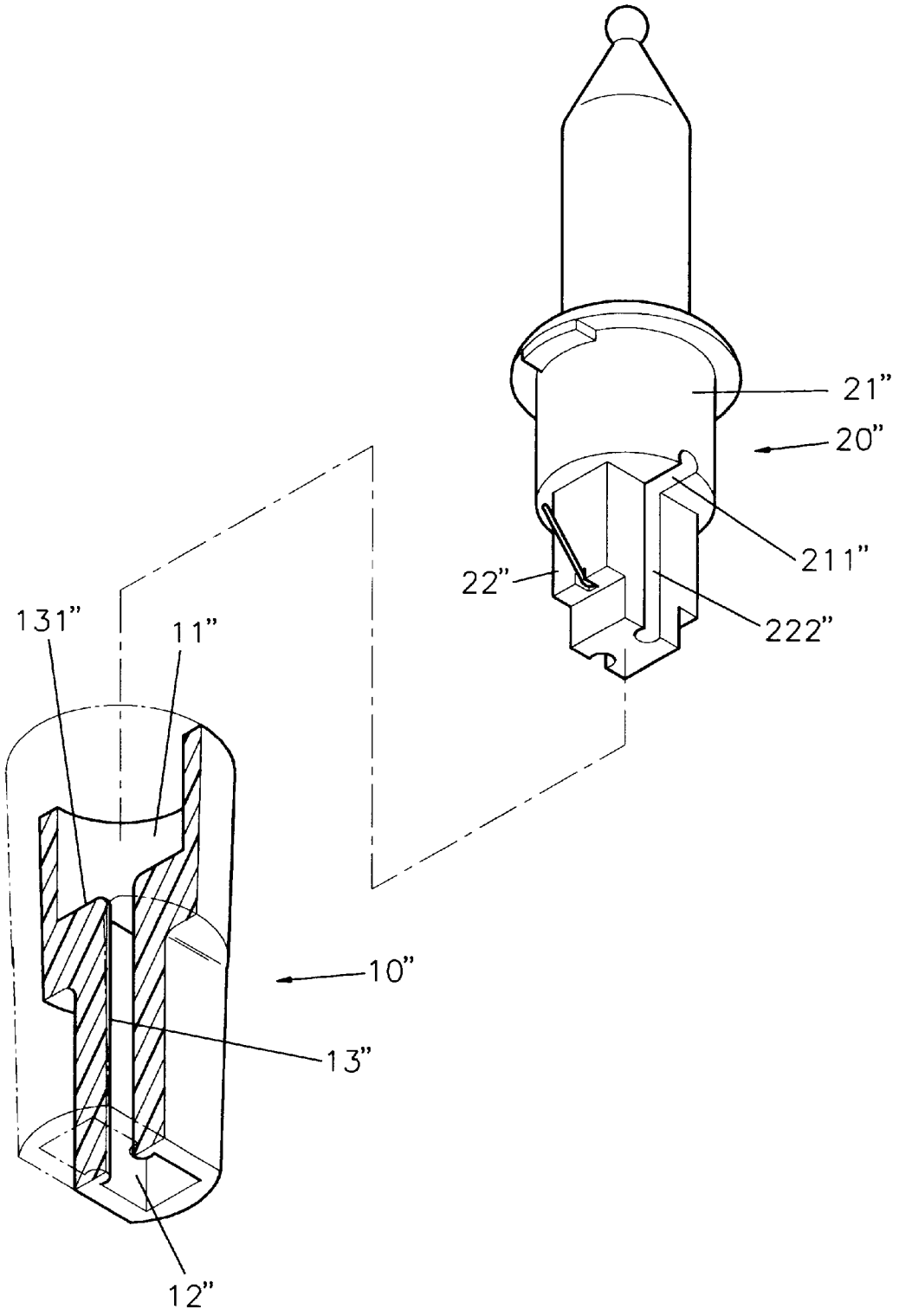
FIG. 7 is a perspective exploded view of a decoration lamp device of a third preferred embodiment.
Figure 8:
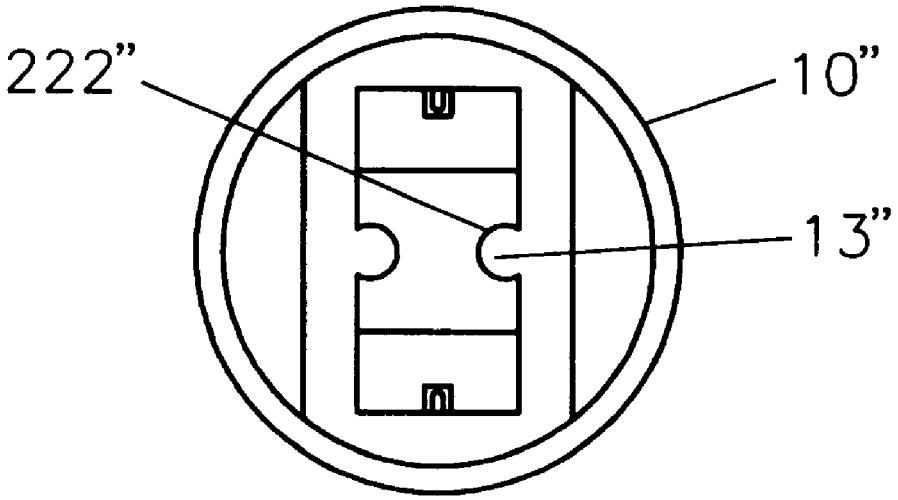
FIG. 8 is a sectional assembly view of a decoration lamp device of a third preferred embodiment.

Referring to FIGS. 7 and 8, a third decoration lamp device comprises a lamp holder 20", and a socket 10" receiving the lamp holder 20".

The lamp holder 20" has a cylinder portion 21" and a base portion 22". The base portion 22" has two lateral grooves 222". The cylinder portion 21" has two bottom grooves 211" communicating with the lateral grooves 222". The bottom grooves 211" has a semi-circular cross-section. The lateral grooves 222" has a semicircular cross-section.

The socket 10" has an upper cylinder interior 11", a slot 12" communicating with the upper cylinder interior 11", and two protruded bars 13" in the slot 12" matching the lateral grooves 222". Each protruded bar 13" has an upper end 131" protruded into the upper cylinder interior 11". Each upper end 131" of the protruded bar 13" has a semicircular shape.

The base portion 22" is inserted in the slot 12". The cylinder portion 21" is inserted in the upper cylinder interior 11". Each protruded bar 13" is inserted in the respective lateral groove 222".

Figure 9:
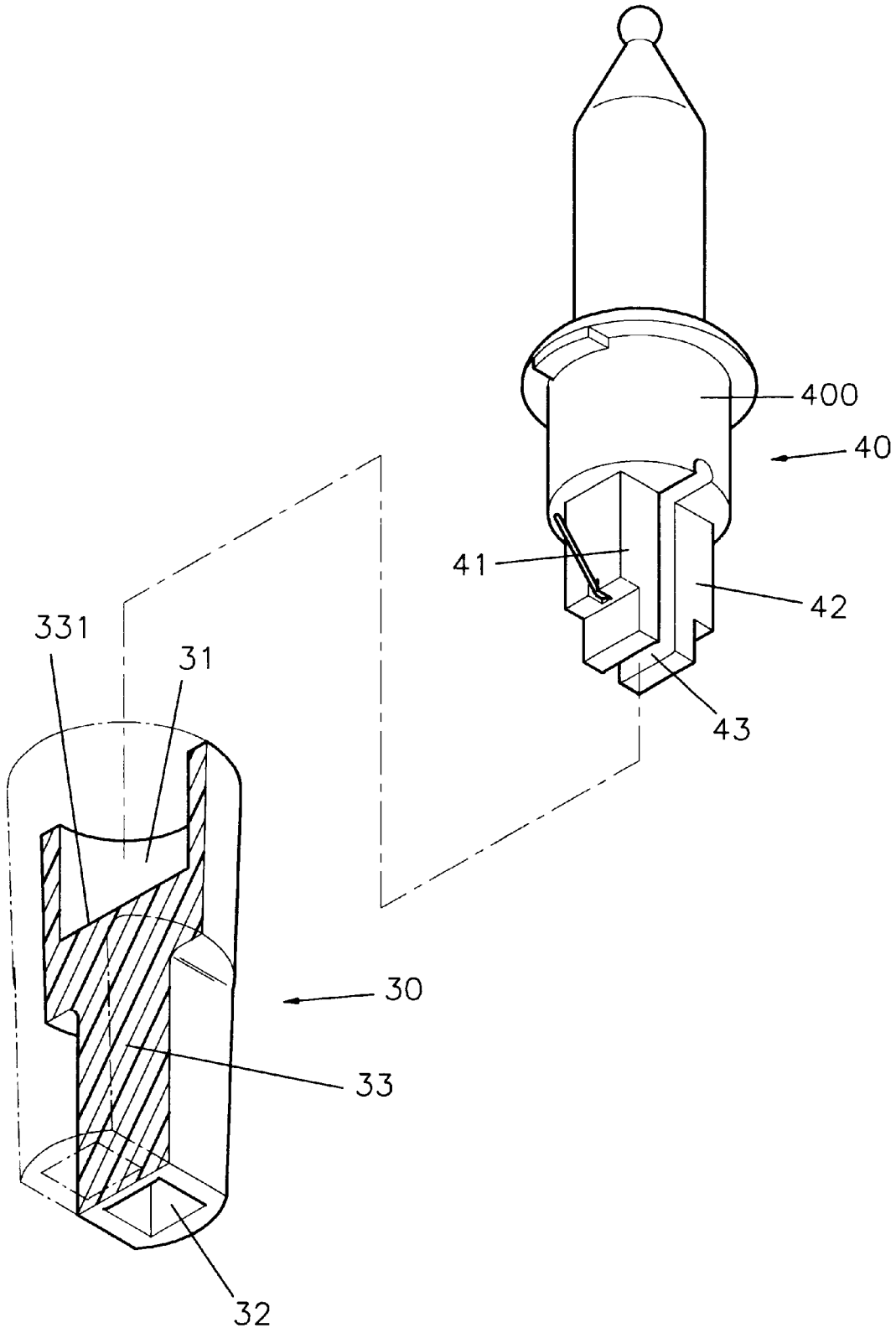
FIG. 9 is a perspective exploded view of a decoration lamp device of a fourth preferred embodiment.

Referring to FIG. 9, a fourth decoration lamp device comprises a lamp holder 40, and a socket 30 receiving the lamp holder 40.

The lamp holder 40 has a cylinder portion 400, a first base plate 41, and a second base plate 42. A spacing 43 is defined between the first base plate 41 and the second base plate 42.

The socket 30 has an upper cylinder interior 31, a slot 32 communicating with the upper cylinder interior 31, and a separation plate 33 in the slot 32. The separation plate 33 has an upper end 331 protruded into the upper cylinder interior 31.

The first base plate 41 and the second base plate 42 are inserted in the slot 32. The cylinder portion 400 is inserted in the upper cylinder interior 31. The separation plate 33 is inserted in the spacing 43.

I claim:

1. A decoration lamp device comprising:

a lamp holder, a bulb disposed on the lamp holder, a socket receiving the lamp holder, the lamp holder having a cylinder portion and a base portion, the base portion having two through apertures receiving two lead-in wires extending from the bulb, and two lateral grooves, and the cylinder portion having two bottom grooves communicating with the lateral grooves.

2. A decoration lamp device as claimed in claim 1, wherein the socket comprises an upper cylinder interior, a slot communicating with the upper cylinder interior, and two protruded bars in the slot matching the lateral grooves, wherein the base portion is inserted in the slot, the cylinder portion is inserted in the upper cylinder interior, and each said protruded bar is inserted in the respective lateral groove.

3. A decoration lamp device as claimed in claim 1, wherein the socket comprises an upper cylinder interior, a slot communicating with the upper cylinder interior, a separation plate in the slot, and two protruded bars protruded upward from the separation plate.

* * * * *